US011421374B2

(12) United States Patent
Park et al.

(10) Patent No.: US 11,421,374 B2
(45) Date of Patent: Aug. 23, 2022

(54) DRYER

(71) Applicant: Samsung Electronics Co., Ltd., Suwon-si (KR)

(72) Inventors: Jun Hong Park, Suwon-si (KR); Guangri Jin, Suwon-si (KR); Jin Baek Kim, Suwon-si (KR); Eung Ryeol Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 169 days.

(21) Appl. No.: 16/788,547

(22) Filed: Feb. 12, 2020

(65) Prior Publication Data

US 2020/0256005 A1 Aug. 13, 2020

(30) Foreign Application Priority Data

Feb. 12, 2019 (KR) ..... 10-2019-0015822

(51) Int. Cl.
*D06F 58/24* (2006.01)
*D06F 58/22* (2006.01)
*D06F 58/04* (2006.01)

(52) U.S. Cl.
CPC ..... *D06F 58/24* (2013.01); *D06F 58/04* (2013.01); *D06F 58/22* (2013.01)

(58) Field of Classification Search
CPC ..... D06F 58/04; D06F 58/20; D06F 58/22; D06F 58/24; D06F 58/206
See application file for complete search history.

(56) References Cited

U.S. PATENT DOCUMENTS 1,736,201 A * 11/1929 Kuenhold ..... D06F 58/10 211/96
1,820,026 A * 8/1931 Otto ..... D06F 58/10 211/169

(Continued)

FOREIGN PATENT DOCUMENTS

CN 102425066 4/2012
CN 202543670 11/2012

(Continued)

OTHER PUBLICATIONS

International Search Report dated May 29, 2020 in International Patent Application No. PCT/KR2020/001474.

(Continued)

*Primary Examiner* — Edelmira Bosques
*Assistant Examiner* — Bao D Nguyen
(74) *Attorney, Agent, or Firm* — Staas & Halsey LLP

(57) ABSTRACT

A dryer includes a cabinet, a drum installed in the cabinet and having an inlet through which air is introduced and an outlet through which air is discharged, a heat exchanger configured to remove moisture of the air discharged through the outlet and increase a temperature of the air, a fan installed between the outlet and the heat exchanger and configured to guide the air discharged through the outlet to be introduced into the heat exchanger, a blowing passage connecting the fan to the heat exchanger such that the air discharged through the fan is introduced into the heat exchanger after being bent at 90 degrees, and a vane installed perpendicular to a bottom surface of the blowing passage and disposed at a portion in the blowing passage in which the air introduced into the heat exchanger has a highest flow rate.

20 Claims, 7 Drawing Sheets

(56) References Cited

U.S. PATENT DOCUMENTS 3,190,011 A * 6/1965 Shields ..... D06F 43/086 34/607
3,754,336 A * 8/1973 Feild ..... B60S 3/002 34/232
4,621,438 A * 11/1986 Lanciaux ..... D06F 58/06 34/604
4,785,986 A * 11/1988 Daane ..... F26B 13/104 242/615.11
4,901,449 A * 2/1990 Wimberger ..... F26B 13/104 34/641
5,070,627 A * 12/1991 Zagar ..... F26B 13/10 34/641
5,070,628 A * 12/1991 Zagar ..... B05C 11/06 34/644
5,156,312 A * 10/1992 Kurie ..... F26B 13/104 34/643
5,159,766 A * 11/1992 Henig ..... F26B 21/08 34/604
5,395,029 A * 3/1995 Kurie ..... F26B 13/104 226/7
5,819,431 A * 10/1998 Lancer ..... A61L 2/22 34/90
6,202,323 B1 * 3/2001 Moller ..... F26B 13/10 34/631
2004/0079121 A1 * 4/2004 Yabuuchi ..... D06F 25/00 68/19
2005/0198851 A1 * 9/2005 Tomochika ..... D06F 58/20 34/74
2005/0198852 A1 * 9/2005 Ono ..... D06F 58/20 34/604
2006/0080974 A1 * 4/2006 Ono ..... D06F 58/206 62/93
2008/0235977 A1 * 10/2008 Kuwabara ..... D06F 58/206 134/105
2010/0071224 A1 * 3/2010 Chung ..... D06F 58/24 34/218
2010/0132209 A1 * 6/2010 Park ..... D06F 58/203 34/201
2010/0223960 A1 * 9/2010 Kim ..... D06F 25/00 68/20
2012/0246960 A1 * 10/2012 Lee ..... D06F 58/22 34/86
2014/0041249 A1 * 2/2014 Jung ..... F26B 23/001 34/282
2014/0165416 A1 * 6/2014 Pillot ..... D06F 58/20 34/82
2014/0208609 A1 * 7/2014 Han ..... D06F 58/38 34/130
2015/0176191 A1 * 6/2015 Hong ..... D06F 39/12 34/132
2015/0247279 A1 * 9/2015 Bison ..... D06F 58/22 34/82
2015/0284897 A1 * 10/2015 Reid ..... D06F 58/22 34/82
2016/0201252 A1 * 7/2016 Lee ..... D06F 58/206 34/130
2016/0201985 A1 * 7/2016 Lee ..... D06F 58/20 34/73
2017/0159217 A1 * 6/2017 Miao ..... D06F 25/00
2017/0159218 A1 * 6/2017 Zhu ..... D06F 58/20
2017/0159219 A1 * 6/2017 Qian ..... D06F 58/206
2017/0159220 A1 * 6/2017 Miao ..... D06F 58/206
2017/0191211 A1 * 7/2017 Kim ..... D06F 25/00
2017/0191213 A1 * 7/2017 Kim ..... D06F 58/206
2017/0342645 A1 * 11/2017 Lu ..... D06F 58/206
2018/0044845 A1 * 2/2018 Bocchino ..... B08B 3/02
2018/0171537 A1 * 6/2018 Lee ..... D06F 58/22
2018/0245271 A1 * 8/2018 Bocchino ..... D06F 58/22
2018/0245272 A1 * 8/2018 Bocchino ..... D06F 58/22
2018/0245273 A1 * 8/2018 Bocchino ..... D06F 58/22
2018/0245274 A1 * 8/2018 Bocchino ..... D06F 58/22
2019/0323164 A1 * 10/2019 Kim ..... D06F 58/50

FOREIGN PATENT DOCUMENTS

| | | |
|---|---|---|
| CN | 205775470 | 12/2016 |
| CN | 106337269 | 1/2017 |
| CN | 106592182 | 4/2017 |
| CN | 108797056 | 11/2018 |
| DE | 196 44 711 | 4/1998 |
| DE | 10 2017 103 633 | 4/2018 |
| EP | 2423375 | 2/2012 |
| EP | 3252214 | 12/2017 |
| EP | 3023531 | 6/2018 |
| JP | 2008-301941 | 12/2008 |
| JP | 2017-483 | 1/2017 |
| KR | 20-2001-0001932 | 1/2001 |
| KR | 10-0635635 | 10/2006 |
| KR | 10-0787060 | 12/2007 |
| KR | 10-2019-0000147 | 1/2019 |

OTHER PUBLICATIONS

Extended European Search Report dated Feb. 7, 2022 from European Application No. 20755748.9.

* cited by examiner

DRYER

CROSS-REFERENCE TO RELATED APPLICATION(S)

This application is based on and claims priority under 35 U.S.C. § 119 to Korean Patent Application No. 10-2019-0015822, filed on Feb. 12, 2019 in the Korean Intellectual Property Office, the disclosure of which is incorporated herein by reference.

BACKGROUND

1. Field

The disclosure relates to a dryer that may improve a flow uniformity of air flowing into a heat exchanger.

2. Description of the Related Art

In general, a dryer refers to a device for drying a wet object to be dried by rotating a drum accommodating the object at a low speed, and allowing hot and dry air to pass through the drum.

As a general example of the dryer, there has been increasing use of a clothing dryer in which laundry caused to be wet in the process of being washed is dried.

The dryer may be classified into an electric dryer and a gas dryer according to a method of heating air, that is, a power source.

The electric dryer heats air using electric resistance heat, and the gas dryer heats air using heat generated by combustion of gas.

In addition, the dryer is classified into an exhaust type dryer and a circulation type dryer according to a method of processing moisture absorbed from an object to be dried.

The exhaust type dryer exhausts humid air from a drum through an exhaust duct to the outside.

The circulation type dryer uses a circulation method in which humid air from a drum is dehydrated and is heated, and then is returned to the drum such that circulation is performed, and to this end, the drum is provided with and an outlet through which air is discharged and an inlet through which air is introduced.

Since the outlet and the inlet are connected to each other by a circulation passage while forming a closed loop of an air flow, the circulation type driver has difficulty using gas as a heat source and the need to use electricity requiring high maintenance costs, but it may obviate the need for an exhaust duct because air circulates between an object to be dried in the drum and a heat pump system.

In the case of a circulation type dryer, which does not exhaust air, a heat exchanger including a condenser and an evaporator is installed in a circulation passage, and air discharged through an outlet is caused to flow by a fan into the heat exchanger.

The air discharged from the fan is introduced into the heat exchanger through a blowing passage which is bent at 90 degrees, and the flow rate of air introduced into the heat exchanger in the blowing passage is different at each section.

In particular, when air passes through the blowing passage, the flow of air is biased to one side by inertia, and in the portion in which the flow of air is biased, air has the highest flow rate, and thus the flow uniformity of the air flowing into the heat exchanger is lowered

SUMMARY

Therefore, it is an object of the present disclosure to provide a dryer in which a vane is installed in a blowing passage to improve the flow uniformity of air introduced into a heat exchanger.

Additional aspects of the disclosure will be set forth in part in the description which follows and, in part, will be obvious from the description, or may be learned by practice of the disclosure.

Therefore, it is an aspect of the disclosure to provide a dryer including: a cabinet; a drum installed in the cabinet and having an inlet through which air is introduced and an outlet through which air is discharged; a heat exchanger configured to remove moisture of the air discharged through the outlet and increase a temperature of the air; a fan installed between the outlet and the heat exchanger and configured to guide the air discharged through the outlet to be introduced into the heat exchanger; a blowing passage connecting the fan to the heat exchanger such that the air discharged through the fan is introduced into the heat exchanger after being bent at 90 degrees; and a vane installed perpendicular to a bottom surface of the blowing passage and disposed at a portion in the blowing passage in which the air introduced into the heat exchanger has a highest flow rate.

The vane may be formed perpendicular to a flowing direction of the air.

The vane may include a through hole that allows some of air colliding with the vane to pass therethrough to thereby reduce a flow resistance of the air colliding with the vane.

The vane may reduce a flow rate of the air introduced into the heat exchanger to improve a flow uniformity of the air introduced into the heat exchanger.

The through hole may include a plurality of through holes arranged along a longitudinal direction of the vane.

The through hole may be formed as a slit elongated in a traverse direction.

The through hole may be formed in a circular shape.

The through hole may include a plurality of through holes arranged in a zig-zag manner along a longitudinal direction of the vane.

The blowing passage may include a first wall connected to the fan and a second wall connecting the first wall to the heat exchanger.

The air introduced into the heat exchanger may have a highest flow rate at portions adjacent to the first wall and the second wall in the blowing passage, and the vane may be installed at a middle portion of the first wall.

A first filter for primarily collecting foreign substances in the air discharged from the drum may be provided on the outlet, and a second filter for secondarily collecting foreign substances in the air introduced into the heat exchanger may be provided between the fan and the heat exchanger.

It is another aspect of the disclosure to provide a dryer including: a cabinet; a drum installed in the cabinet and having an inlet through which air is introduced and an outlet through which air is discharged; a heat exchanger configured to remove moisture of the air discharged through the outlet and increase a temperature of the air; a fan installed between the outlet and the heat exchanger and configured to guide the air discharged through the outlet to be introduced into the heat exchanger; a circulation passage connecting the outlet to the inlet to perform circulation of air, and including a blowing passage connecting the fan to the heat exchanger such that the air discharged through the fan is introduced into the heat exchanger after being bent at 90 degrees; and a vane disposed at a portion in the blowing passage in which the air introduced into the heat exchanger has a highest flow rate, wherein the vane includes a plurality of through holes that allow some of the air colliding with the vane to pass therethrough to thereby reduce a flow resistance of the air colliding with the vane.

The vane may be formed perpendicular to a flowing direction of the air.

The vane may reduce a flow rate of the air introduced into the heat exchanger through the air colliding with the vane, and reduce a flow resistance of the air through the plurality of through holes, to improve a flow uniformity of the air introduced into the heat exchanger.

The blowing passage may include a first wall connected to the fan and a second wall connecting the first wall to the heat exchanger.

The air introduced into the heat exchanger may have a highest rate at portions adjacent to the first wall and the second wall in the blowing passage, and the vane may be located at a middle portion of the first wall while being installed perpendicular to a bottom surface of the blowing passage.

The plurality of through holes may be arranged along a longitudinal direction of the vane.

The plurality of through holes may be each formed as a slit elongated in a traverse direction.

The plurality of through holes may be each formed in a circular shape.

The plurality of through holes may be arranged in a zig-zag manner along a longitudinal direction of the vane.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
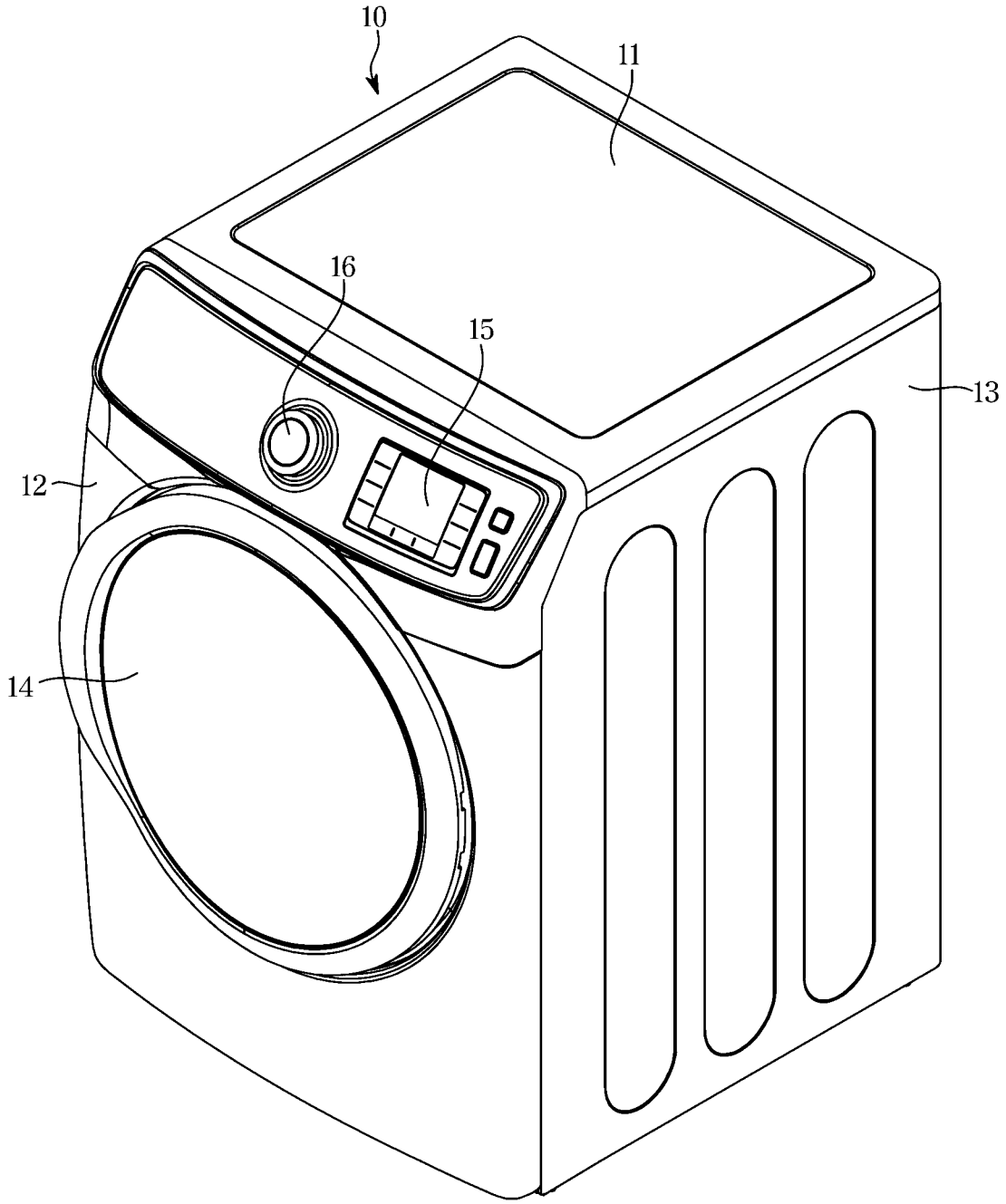
FIG. 1 is a schematic perspective view illustrating a dryer according to an embodiment of the disclosure.

The embodiments set forth herein and illustrated in the configuration of the disclosure are only the most preferred embodiments and are not representative of the full the technical spirit of the disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Hereinafter, the embodiments of the disclosure will be described with reference to the accompanying drawings in detail.

Figure 2:
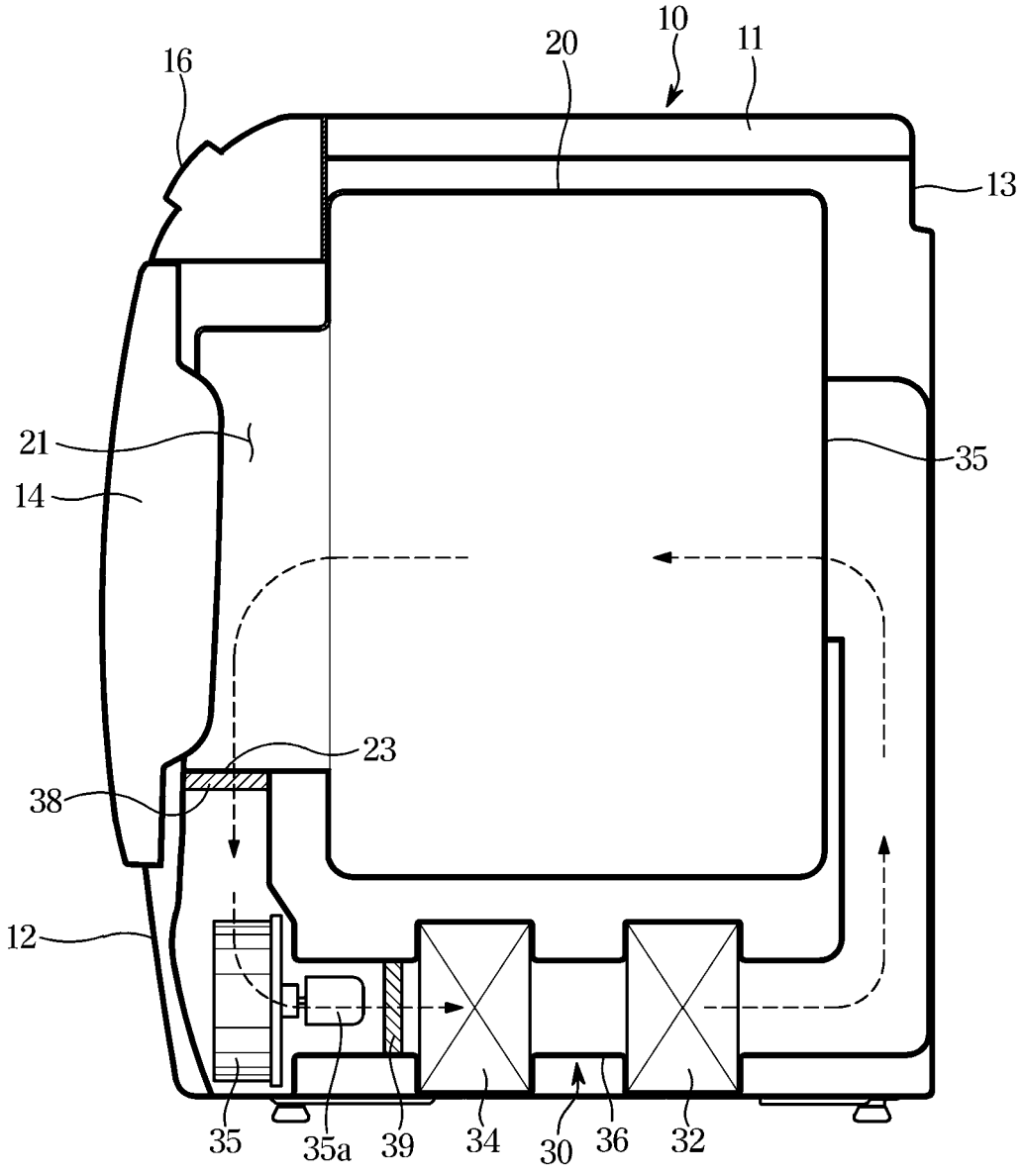
FIG. 2 is a schematic cross-sectional view illustrating a side section of a dryer according to an embodiment of the disclosure.
Figure 3:
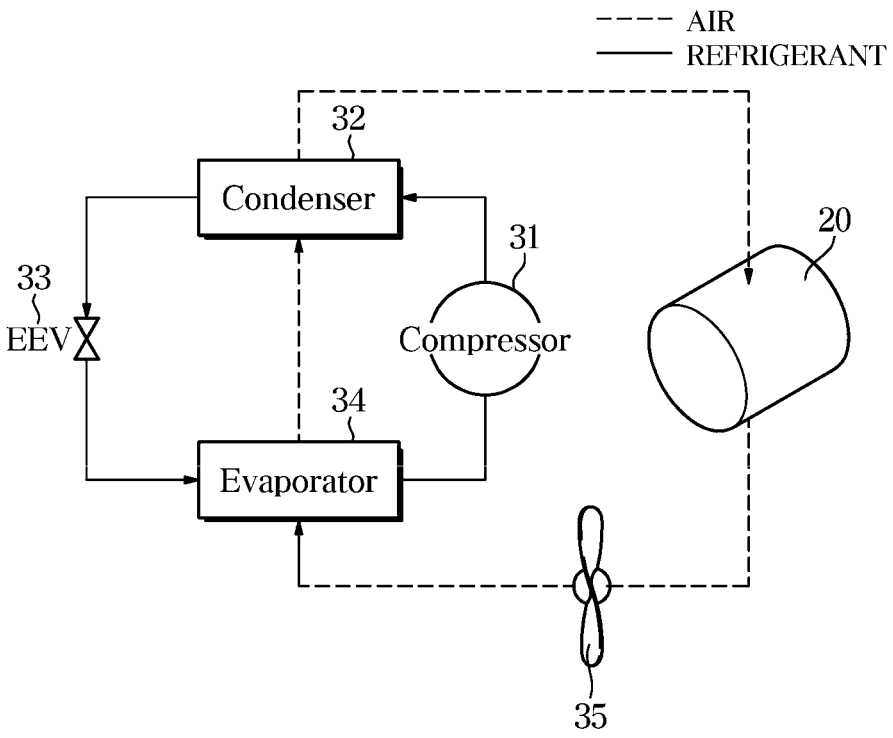
FIG. 3 is a view illustrating the flow of refrigerant and air in a drying apparatus according to an embodiment of the disclosure.

FIG. 1 is a schematic perspective view illustrating a dryer according to an embodiment of the disclosure, FIG. 2 is a schematic cross-sectional view illustrating a side section of the dryer according to the embodiment of the disclosure, and FIG. 3 is a view illustrating the flow of refrigerant and air in a drying apparatus according to the embodiment of the disclosure.

Referring to FIGS. 1 to 2, the dryer includes a cabinet 10 forming the external appearance thereof, and the cabinet 10 may include a top cover 11, a front cover 12, and a side rear cover 13. A display 15 and a rotary switch 16 for controlling a washing machine may be disposed on the upper end of the front cover 12.

The rotary switch 16 may be provided to be gripped and rotated by a user to select a mode of the dryer.

The display 15 may display an operation state of the dryer and a manipulation state of the user.

Inside the cabinet 10, a drum 20 is rotatably installed such that clothing, such as an object to be dried, is introduced into the drum 20.

A door 14 is provided at the front of the cabinet 10, and the door 14 is rotatably installed on the cabinet 10 to open and close an inlet port 21 provided at the front of the drum 20.

The interior of the drum 20 is connected to the inlet port 21 such that when the inlet port 21 is opened, an object to be dried is introduced into the drum 20 through the door 14 or the dried object is taken out of the drum 20 through the door 14.

The drum 20 may include an outlet 23 through which air is discharged and an inlet 25 through which air is suctioned.

The outlet 23 and the inlet 25 may be connected to each other by a circulation passage 36 of a drying apparatus 30.

The outlet 23 and the inlet 25 may be connected to each other by the circulation passage 36 such that the flow of air forms a closed loop.

Therefore, air converted to be hot and humid after drying the object to be dried in the drum 20 is discharged to the outlet 23. The hot and humid air discharged to the outlet 23 is moved to the inlet 25 through the circulation passage 36. In this case, the hot and humid air passing through the circulation passage 36 is subject to heat-exchange by a heat exchanger including an evaporator 34 and a condenser 32 installed in the circulation passage 36. That is, the hot and humid air, while passing through the evaporator 34, is dehumidified and converted into cold and dry air. The cold and dry air, while passing through the condenser 32, is converted into hot and dry air having an increased temperature, and then is moved to the inlet 25. The hot and dry air moved to the inlet 25 is suctioned into the drum 20 through the inlet 25. The hot and dry air suctioned into the drum 20 may dry the object to be dried inside the drum 20.

The dryer may be provided with a heat pump type drying apparatus 30 for drying an object to be dried in the drum 20.

The heat pump type drying apparatus 30 includes a compressor 31, the condenser 32, an expansion device 33, the evaporator 34 and a fan 35, and refrigerant circulates through the compressor 31, the condenser 32, the expansion device 33, and the evaporator 34.

The heat pump type drying apparatus 30 further includes the circulation passage 36 connecting the outlet 23 to the inlet 25 of the drum 20, and air is circulated by the fan 35 installed in the circulation passage 36. The fan 35 may be driven by a drive motor 35*a*.

Since air is circulated without being exhausted to the outside, foreign substances, such as dust existing in the dryer or lint or the like generated in the process of drying an object to be dried, may be suctioned into the heat pump type drying apparatus 30. When foreign substances, such as lint or the like, are suctioned into the heat pump type drying apparatus 30, the efficiency of the dryer may be lowered. Thus, filters 38 and 39 may be installed in the circulation passage 36. The filters 38 and 39 may include a first filter 38 installed on the outlet 23 and primarily collecting foreign substances in the air discharged from the drum 20 through the outlet 23 and a second filter 39 installed between the fan 35 and the evaporator 34 and secondarily collecting foreign substances in the air introduced into the evaporator 34.

Referring to FIG. 3, in the heat pump type drying apparatus 30, a refrigerant circulates through the compressor 31, the condenser 32, the expansion device 33, and the evaporator 34, and forms a cycle composed of compression-condensation-expansion-evaporation.

The condenser 32 and the evaporator 34 may be provided as a heat exchanger capable of heat exchanging with air.

The compressor 31 compresses refrigerant gas into high temperature and high pressure refrigerant gas and discharges the high temperature and high pressure refrigerant gas to be introduced into the condenser 32, and the condenser 32 condenses the compressed refrigerant gas into a liquid refrigerant and in the process of the condensation, releases heat to the surroundings.

The expansion device 33 expands the high temperature and high pressure liquid refrigerant having been condensed in the condenser 32 into a low pressure liquid refrigerant.

The evaporator 34 evaporates the refrigerant having been expanded in the expansion device 33, returns low temperature and low pressure refrigerant gas to the compressor 31, and in the process of evaporating the liquid refrigerant into refrigerant gas, acquires heat from the surroundings.

Air circulating in the drum 20 through the circulation passage 36 is heated by passing through the condenser 32 into hot and dry air.

The hot and dry air is guided to the inlet 25 by the fan 35, and is introduced into the drum 20 through the inlet 25 to dry an object to be dried.

The air having acquired moisture from the object to be dried is converted again into hot and humid air containing a large amount of vapor, and the hot and humid air discharged from the drum 20 through the outlet 23 is guided by the fan 35 to pass through the evaporator 34.

The air having lost heat by passing through the evaporator 34 is cooled, so that the amount of water vapor contained in the air is reduced, and the hot and humid air discharged from the drum 20 is converted into cold and dry air while passing through the evaporator 34.

The air becoming cold and dry while passing through the evaporator 34 is converted into hot and dry air again while passing through the condenser 32 and is suctioned into the drum 20.

Figure 4:
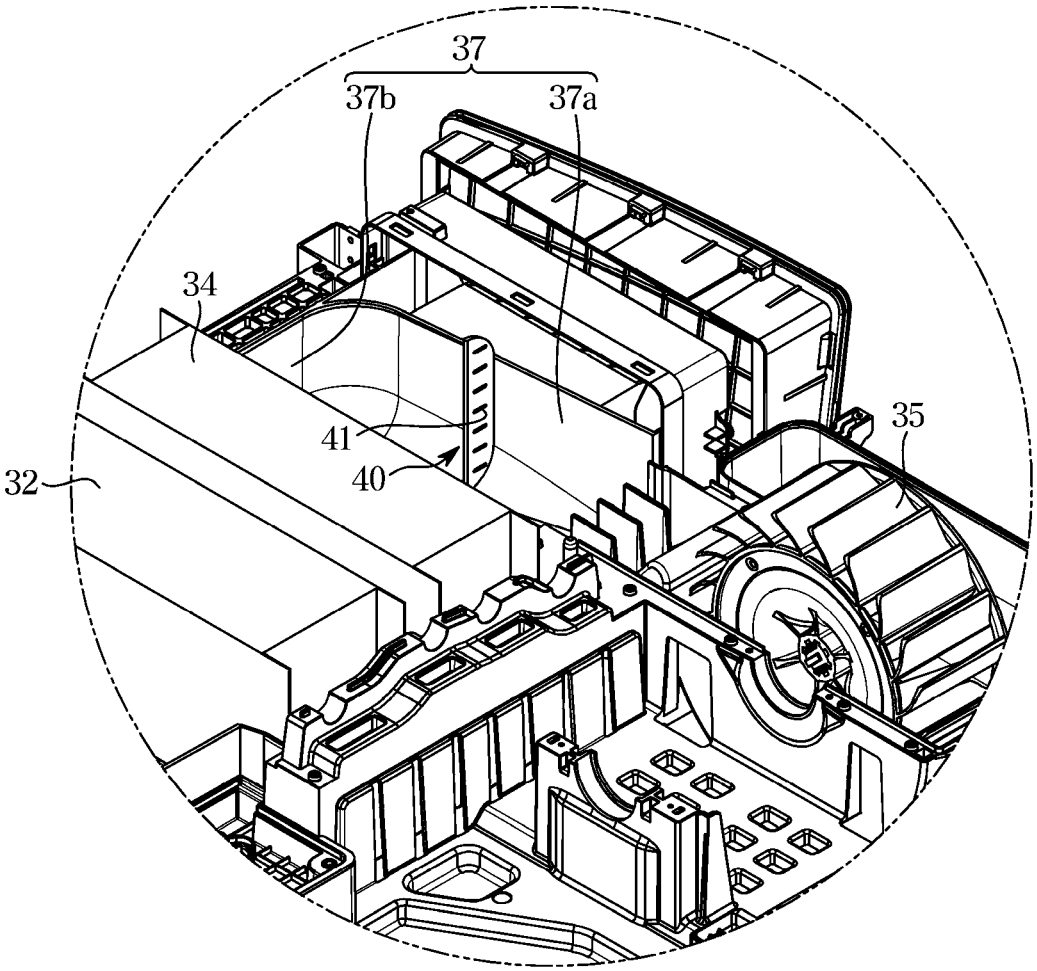
FIG. 4 is a view illustrating a fan, a heat exchanger, and a vane installed in a blowing passage for connecting the fan to the heat exchanger installed in a dryer according to an embodiment of the disclosure.
Figure 5:
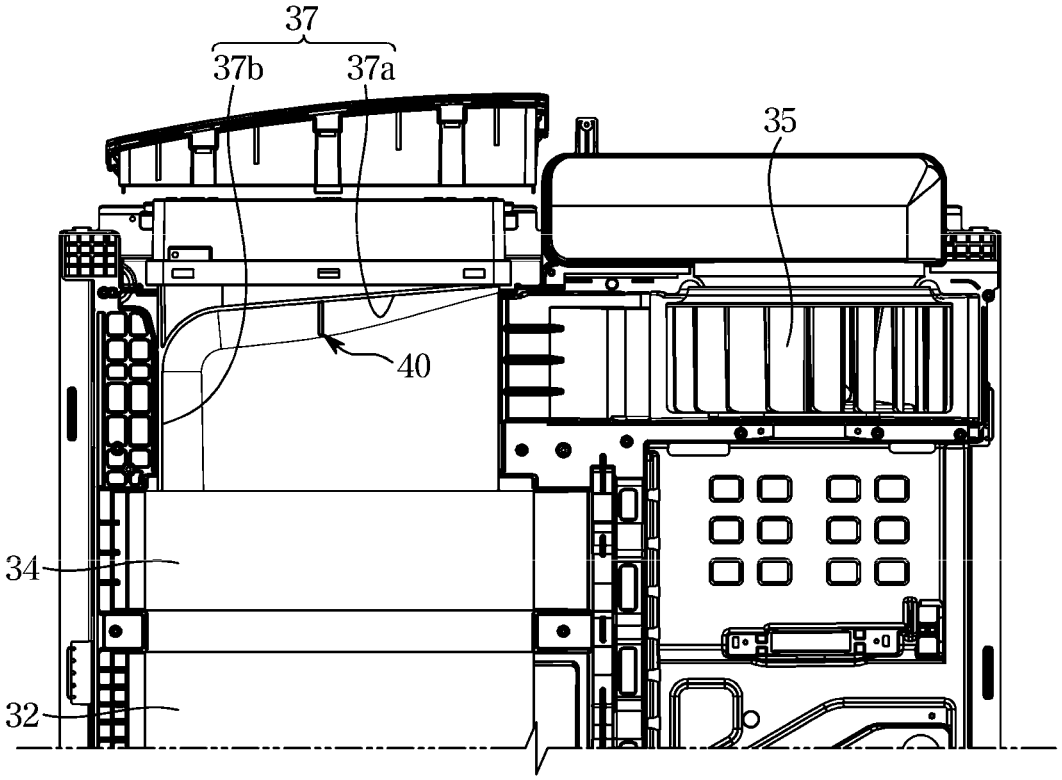
FIG. 5 is a plan view illustrating a fan, a heat exchanger, and a vane installed in a blowing passage for connecting the fan to the heat exchanger installed in a dryer according to an embodiment of the disclosure.

FIG. 4 is a view illustrating a fan, a heat exchanger, and a vane installed in a blowing passage for connecting the fan to the heat exchanger installed in a dryer according to an embodiment of the disclosure, and FIG. 5 is a plan view illustrating a fan, a heat exchanger, and a vane installed in a blowing passage for connecting the fan to the heat exchanger installed in a dryer according to an embodiment of the disclosure.

Referring to FIGS. 4 to 5, the fan 35 and the heat exchanger including the evaporator 34 and the condenser 32 may be connected to each other by a blowing passage 37. The blowing passage 37 may be included in the circulation passage 36.

The blowing passage 37 may connect the fan 35 to the heat exchanger such that air discharged through the fan 35 is introduced into the heat exchanger after being bent at 90 degrees. The fan 35 may be installed between the outlet 23 and the heat exchanger, and may be configured to guide the air discharged through the outlet 23 to be introduced into the heat exchanger (see FIG. 2).

The blowing passage 37 may include a first wall 37*a* connected to the fan 35 and a second wall 37*b* connecting the first wall 37*a* to the heat exchanger.

The flow rate of air in the blowing passage 37 is different for each section, and in portions adjacent to the first wall 37*a* and the second wall 37*b* of the blowing passage 37, the air may have the highest flow rate due to inertia in the blowing passage 37.

Since the flow rate of air in the blowing passage 37 is different for each section, the flow uniformity of air introduced into the heat exchanger may be lowered, so that the thermal performance of the heat exchanger may be lowered, and the efficiency of the dryer also may be lowered.

In order to reduce the flow rate of air passing through the portions adjacent to the first wall 37*a* and the second wall 37*b* having the highest flow rate of air in the blowing passage 37, a vane 40 may be installed at a middle portion of the first wall 37*a*.

The vane 40 may be installed perpendicular to the bottom surface of the blowing passage 37 so as to be positioned at a middle portion of the first wall 37*a*. Accordingly, the air passing through the portions adjacent to the first wall 37*a* and the second wall 37*b* may collide with the vane 40 and change the flowing direction, so that the flow rate of the air may be reduced.

By reducing the flow rate of a portion having the highest flow rate of the air in the blow passage 37, the overall variation of the flow rates of air in the blow passage 37 is reduced, so that the flow uniformity of the air introduced into the heat exchanger may be improved.

The vane 40 may include a through hole 41 that allows some of air colliding with the vane 49 to pass therethrough. The through hole 41 may include a plurality of through holes 41 arranged in a longitudinal direction of the vane 40. As the plurality of through holes 41 are formed in the vane 40, some of air passes through the plurality of through holes 41, and thus a flow resistance generated due to air colliding with the vane 40 may be reduced.

Therefore, when the vane 40 is installed at the middle portion of the first wall 37*a* among the portions adjacent to the first wall 37*a* and the second wall 37*b* having the highest flow rate in the blowing passage 37, the flow uniformity of the air introduced into the heat exchanger may be improved and the flow resistance of the air may be reduced.

Although the vane 40 is illustrated as being installed at the middle portion of the first wall 37*a* in the drawings, the vane 40 may be installed in any of portions adjacent to the first wall 37*a* and the second wall 37*b* having a highest flow rate in the blowing passage 37.

The through hole 41 may be formed as a slit elongated in a traverse direction. However, the through hole 41 may be formed in any other shape as long as it can be passed by air colliding with the vane 40. In addition, the through hole 41 may have various sizes as long as it is not too small.

Figure 6:
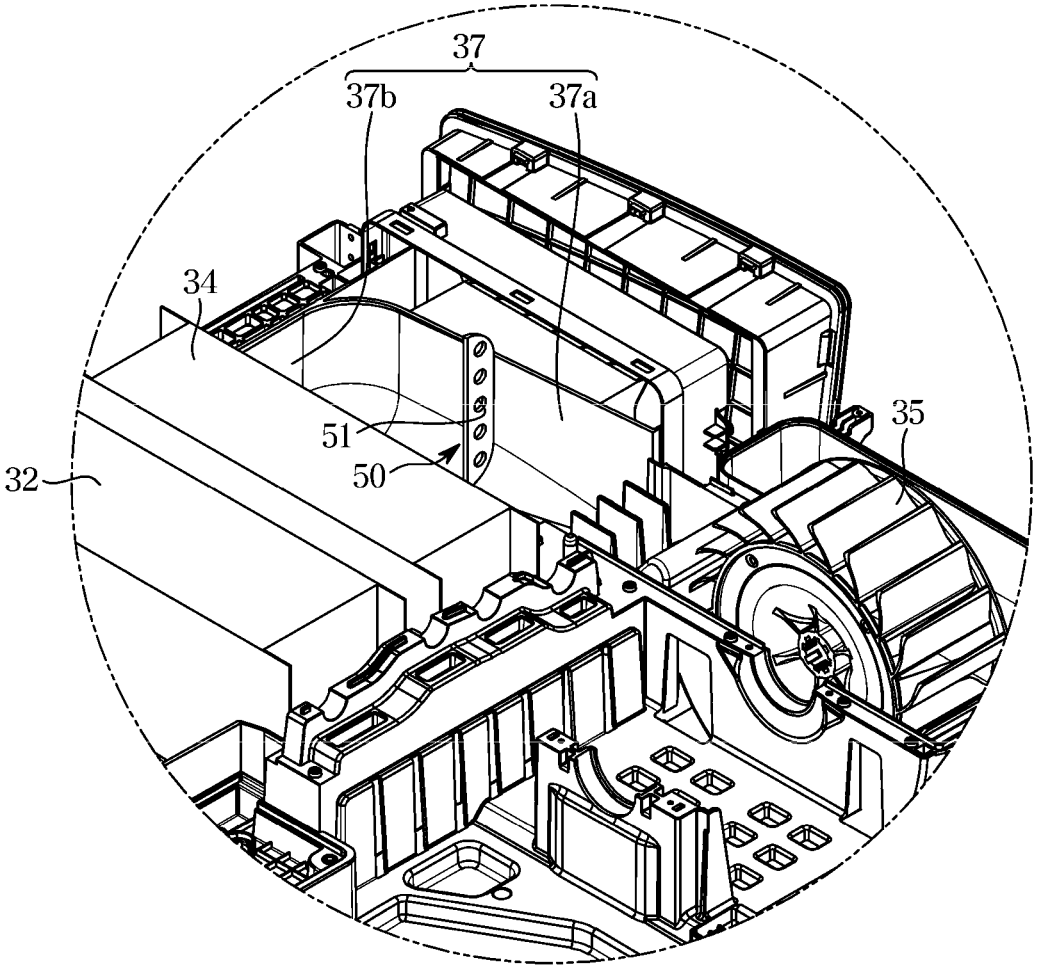
FIG. 6 is a view illustrating another embodiment of the vane shown in FIG. 4.
Figure 7:
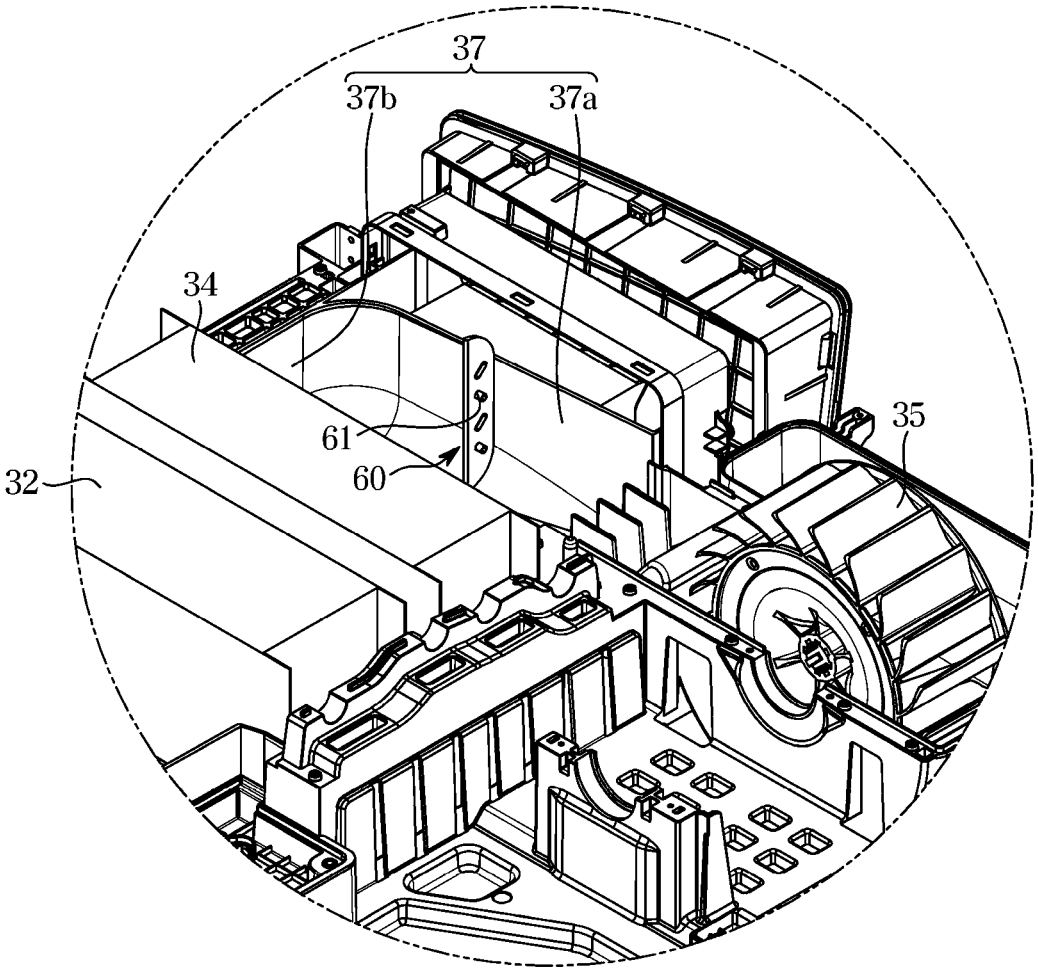
FIG. 7 is a view illustrating another embodiment of the vane shown in FIG. 4.

FIG. 6 is a view illustrating another embodiment of the vane shown in FIG. 4, and FIG. 7 is a view illustrating another embodiment of the vane shown in FIG. 4.

Referring to FIG. 6, a vane 50 may include a plurality of through holes 51 having a circular shape and arranged in a longitudinal direction of the vane 50.

Referring to FIG. 7, a vane 60 may include a plurality of through holes 61 each formed as a slit elongated in a traverse direction, and the through holes 61 may be arranged in a zig-zag manner along a longitudinal direction of the vane 60.

As is apparent from the above, the efficiency of the dryer can be enhanced by improving the flow uniformity of air flowing into the heat exchanger.

What is claimed is:

1. A dryer comprising:

a cabinet;

a drum installed in the cabinet and having an inlet through which air is introduced into the drum and an outlet through which air is discharged from the drum;

a heat exchanger configured to remove moisture of the air discharged from the outlet and increase a temperature of the air discharged from the outlet;

a fan installed in the cabinet and allowing the air discharged from the outlet to be introduced into the heat exchanger;

a blowing passage consisting of:

parallel vanes positioned at an output of the fan;

a first wall extending toward the fan;

a second wall disposed at an angle with respect to the first wall; and a vane extending from the first wall in parallel with the second wall, the blowing passage connecting the fan to the heat exchanger such that the air discharged from the fan is moved into the heat exchanger after being deflected; and so as to guide air flowing in the blowing passage toward the heat exchanger.

2. The dryer of claim 1, wherein the vane is formed perpendicular to a flowing direction of the air through the blowing passage.

3. The dryer of claim 2, wherein the vane includes a through hole that allows some of the air colliding with the vane to pass therethrough to thereby reduce a flow resistance of the air colliding with the vane.

4. The dryer of claim 3, wherein the vane reduces a flow rate of the air discharged from the outlet to improve a flow uniformity of air introduced into the heat exchanger.

5. The dryer of claim 4, wherein the through hole includes a plurality of through holes arranged along a longitudinal direction of the vane.

6. The dryer of claim 5, wherein the through hole is formed as a slit elongated in a transverse direction of the vane.

7. The dryer of claim 5, wherein the through hole is formed in a circular shape.

8. The dryer of claim 4, wherein the through hole includes a plurality of through holes arranged in a zig-zag manner along a longitudinal direction of the vane.

9. The dryer of claim 1, wherein the first wall extends to the fan and the second wall extends to the heat exchanger.

10. The dryer of claim 9, wherein the air discharged from the outlet has a highest flow rate at portions adjacent to the first wall and the second wall in the blowing passage, and the vane is installed at a middle portion of the first wall.

11. The dryer of claim 1, wherein a first filter for primarily collecting foreign substances in the air discharged from the drum is provided on the outlet, and a second filter for secondarily collecting foreign substances in air introduced into the heat exchanger is provided upstream of the heat exchanger.

12. A dryer comprising:

a cabinet;

a drum installed in the cabinet and having an inlet through which air is introduced into the drum and an outlet through which air is discharged from the drum;

a heat exchanger configured to remove moisture of the air discharged from the outlet and increase a temperature of the air discharged from the outlet;

a circulation passage connecting the outlet to the inlet to return the air discharged from the outlet to the inlet, and including a blowing passage including a 90 degree turn; and a fan installed in the cabinet and configured to move the air discharged from the outlet to the heat exchanger, wherein the blowing passage consists of:

parallel vanes positioned at an output of the fan;

a first wall;

a second wall disposed at an angle with respect to the first wall, and a vane extending from the first wall in parallel with the second wall so as to guide air flowing in the blowing passage toward the heat exchanger and including a plurality of through holes that allow some of the air colliding with the vane to pass therethrough to reduce a flow resistance of the air colliding with the vane.

13. The dryer of claim 12, wherein the vane is formed perpendicular to a flowing direction of the air through the blowing passage.

14. The dryer of claim 13, wherein the vane reduces a flow rate of the air discharged from the outlet by the air colliding with the vane, and reduces a flow resistance of the air by the plurality of through holes, to improve a flow uniformity of air introduced into the heat exchanger.

15. The dryer of claim 14, wherein the first wall extends from the fan and the second wall extends to the heat exchanger.

16. The dryer of claim 15, wherein the air discharged from the outlet has a highest flow rate at portions adjacent to the first wall and the second wall in the blowing passage, and the vane is located at a middle portion of the first wall while being installed perpendicular to a bottom surface of the blowing passage.

17. The dryer of claim 12, wherein the plurality of through holes are arranged along a longitudinal direction of the vane.

18. The dryer of claim 17, wherein the plurality of through holes are each formed as a slit elongated in a transverse direction of the vane.

19. The dryer of claim 17, wherein the plurality of through holes are each formed in a circular shape.

20. The dryer of claim 12, wherein the plurality of through holes are arranged in a zig-zag manner along a longitudinal direction of the vane.

* * * * *